US005538068A

United States Patent [19]

Liu

[11] Patent Number: 5,538,068

[45] Date of Patent: Jul. 23, 1996

[54] POSITIONING DRUM DEVICE FOR A VENETIAN BLIND

[76] Inventor: Tai-Ping Liu, No. 15, Alley 8, Lane 3, Kuochi St., Lungching Hsiang, Taichung Hsien, Taiwan

[21] Appl. No.: 370,316

[22] Filed: Jan. 10, 1995

[51] Int. Cl.[6] ..... F06B 9/38

[52] U.S. Cl. ..... 160/177

[58] Field of Search ..... 160/177 R, 176.1 R, 160/178.1 R, 168.1 R, 173 R, 178.1 R, 166.1 R, 172 R

[56] References Cited

U.S. PATENT DOCUMENTS

| | | | |
|---|---|---|---|
| 2,667,220 | 1/1954 | Rutledge | 160/177 R |
| 2,831,536 | 4/1958 | Lorentzen | 160/177 R |
| 3,333,905 | 8/1967 | Hennequin | 160/177 R X |
| 4,487,243 | 12/1984 | Debs | 160/168.1 R |
| 4,494,593 | 1/1985 | Fielder | 160/177 R |
| 4,651,794 | 3/1987 | Bytheway | 160/176.1 R X |
| 4,821,789 | 4/1989 | Van Rens | 160/177 R |
| 5,074,349 | 12/1991 | Yannazzone | 160/177 R |
| 5,139,073 | 8/1992 | Opdahl et al. | 160/177 R |
| 5,267,598 | 12/1993 | Marocco | 160/177 R |

*Primary Examiner*—David M. Purol
*Attorney, Agent, or Firm*—Watson Cole Stevens Davis

[57] ABSTRACT

A positioning drum device for a Venetian blind includes an axial bore horizontally defined through a mediate portion thereof and includes two adjacent elongated recesses defined in one distal end of a top surface of thereof, the elongated recess being substantially V-shaped and having a neck portion with a reduced diameter formed in a mediate portion of the top surface, a pair of retaining openings defined in the top surface and each communicating with the neck portion of a corresponding one of the recesses and each having a diameter greater than that of the associated neck portion, a pair of cords each having one free end extending through a corresponding one of the openings and each having a diameter greater than that of the associated neck portion, a stop mounted on a bottom portion of the free end of each of the cords and having a diameter greater than that of the associated opening.

3 Claims, 4 Drawing Sheets

POSITIONING DRUM DEVICE FOR A VENETIAN BLIND

BACKGROUND OF THE INVENTION

1. Field of Invention

The present invention relates to a positioning drum device, and more particularly to a positioning drum device for a Venetian blind.

2. Related Prior Art

Conventional positioning drum devices for a Venetian blind are shown in FIGS. 5 and 6. However, by such an arrangement, there are still some shortcomings in the conventional positioning drum devices.

There will be a more complete and sufficient illustration in the detailed description of the preferred embodiments, concerning the conventional positioning drum devices.

The present invention has arisen to mitigate and/or obviate the above-mentioned disadvantages of the conventional positioning drum devices.

SUMMARY OF THE INVENTION

The primary objective of the present invention is to provide a positioning drum device with two functions.

In accordance with one aspect of the present invention, there is provided a positioning drum device for a Venetian blind which comprises a headrail substantially U-shaped in section, at least one positioning base fixedly mounted in the headrail, the positioning drum device rotatably mounted in the positioning base and comprising a top surface and a bottom portion, an axial bore horizontally defined through a mediate portion of the positioning drum device, two adjacent elongated recesses defined in one distal end of the top surface of the positioning drum device, the elongated recess being substantially V-shaped and having a neck portion with a reduced diameter formed in a mediate portion of the top surface, a pair of retaining openings defined in the top surface and each communicating with the neck portion of a corresponding one of the recesses and each having a diameter greater than that of the associated neck portion, a pair of cords each having one free end extending through a corresponding one of the openings and each having a diameter greater than that of the associated neck portion, a stop mounted on a bottom portion of the free end of each of the cords and having a diameter greater than that of the associated opening such that the stop is securely retained in the associated opening so as to position each of the free ends in the associated opening.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 5:
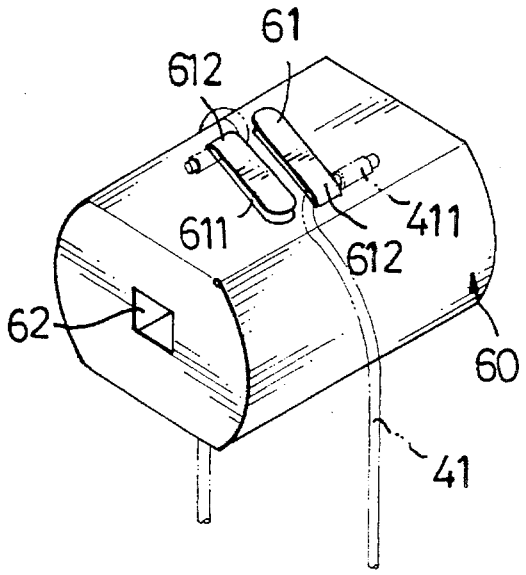
FIG. 5 PRIOR ART
FIG. 5 is a perspective view of a first conventional positioning drum device in accordance with the prior art.

Referring to FIG. 5, a first conventional positioning drum device 60 for a Venetian blind (not shown) in accordance with the prior art is rotatably mounted in a retaining base (not shown) which is fixedly mounted in a headrail (not shown) of the Venetian blind, a rotary shaft (not shown) extending through an axial bore 62 which is longitudinally defined in a mediate portion of the drum device 60 so as to control rotational movement of the drum device 60, a pair of pressing members 61 each having a fixing distal end 612 fixedly formed on a top surface of the drum device 60 and each having a free distal end slightly tilted above the top surface, a slit 611 defined between each of the pressing members 61 and the top surface, a pair of cords 41 each having a first free end extending through a corresponding one of the slits 611, a stop 411 attached to the free end of each of the cords 41 and securely retained by the fixed distal end 612 of the associated pressing member 61, each of the two cords 41 having a second free end extending downwardly to fasten one side of a plurality of slats (not shown) so as to control angular movement and rotational angles of the plurality of slats. By such an arrangement, the stop 411 is easily detached from the fixed distal end 612 of the pressing member 61 such that the free end of the cord 41 is easily released from the slit 611.

Figure 6:
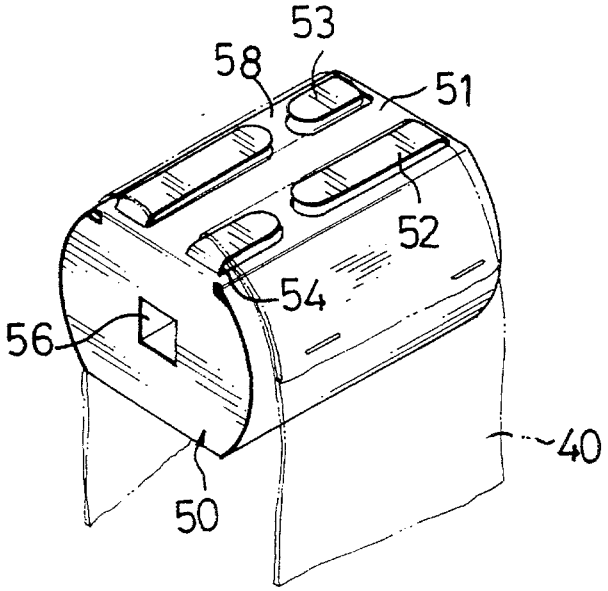
FIG. 6 PRIOR ART
FIG. 6 is a perspective view of a second conventional positioning drum device in accordance with the prior art.

Referring to FIG. 6, a second conventional positioning drum device 50 for a Venetian blind (not shown) in accordance with the prior art is rotatably mounted in a retaining base (not shown) which is fixedly mounted in a headrail (not shown) of the Venetian blind, a rotary shaft (not shown) extending through an axial bore 56 which is longitudinally defined in a mediate portion of the drum device 50 so as to control rotational movement of the drum device 50, two pairs of long tongues 52 and short tongues 53 are serially and alternately formed on a flat top surface 51 of the drum device 50, a slit 54 defined between each of the two pairs of long and short tongues 52 and 53 and the flat top surface 51, a pair of tapes 40 each having a first free end passing through a corresponding one of the slits 54 and enclosing around a corresponding pair of long and short tongues 52 and 53 to form a loop thereof, thereby retaining the free end of each of the tapes 40 in place, each of the two tapes 40 having a second free end extending downwardly to fasten one side of a plurality of slats (not shown) so as to control angular movement and rotational angles of the plurality of slats. By such an arrangement, because a distance between the two pairs of long and short tongues 52 and 53 is short, so it is not easy to form a loop of the first free end of the tapes 40 by manual operation. In addition, there is a space 58 defined between the long tongue 52 and the associated short tongue 53, therefore, the loop formed by the first free end of the tape 40 is easily released from the space 58, so easily-incurring instability during operation.

Figure 1:
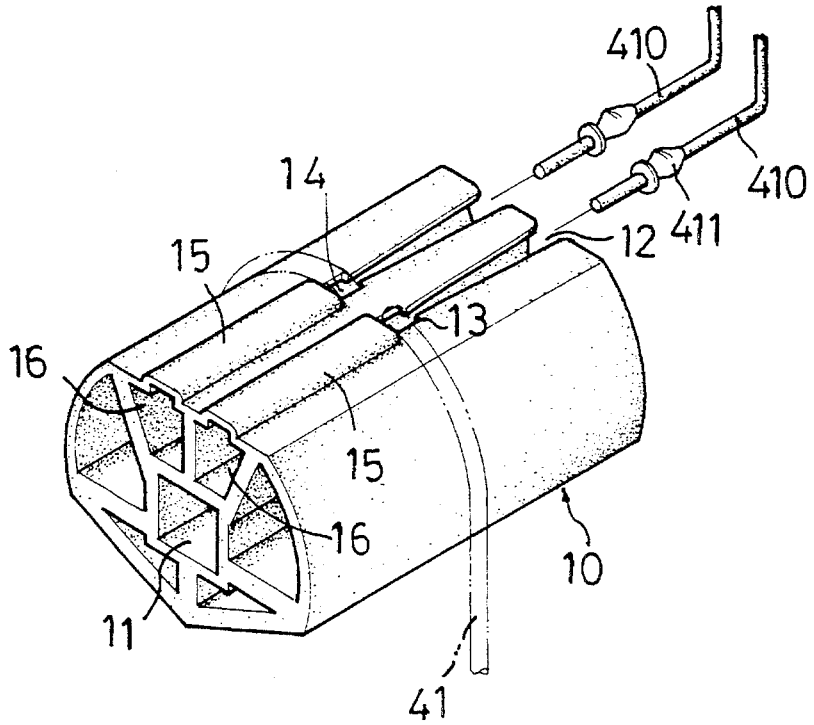
FIG. 1 is a perspective exploded view of a positioning drum device in accordance with a first embodiment of the present invention.
Figure 2:
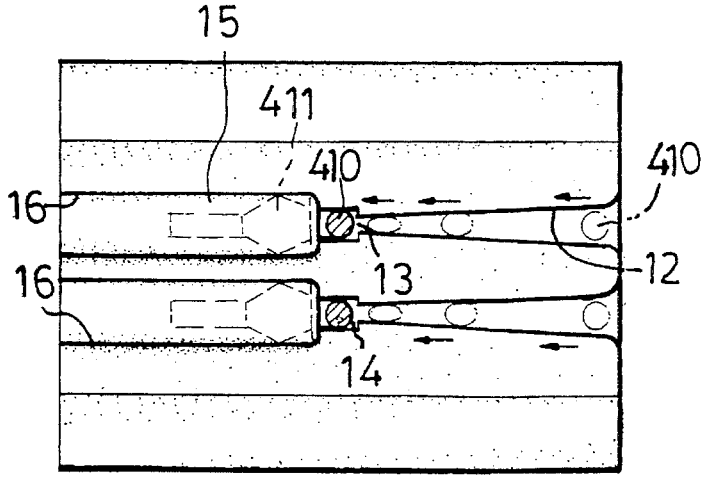
FIG. 2 is a top plan cross-sectional operational view of the positioning drum device as shown in FIG. 1.
Figure 3:
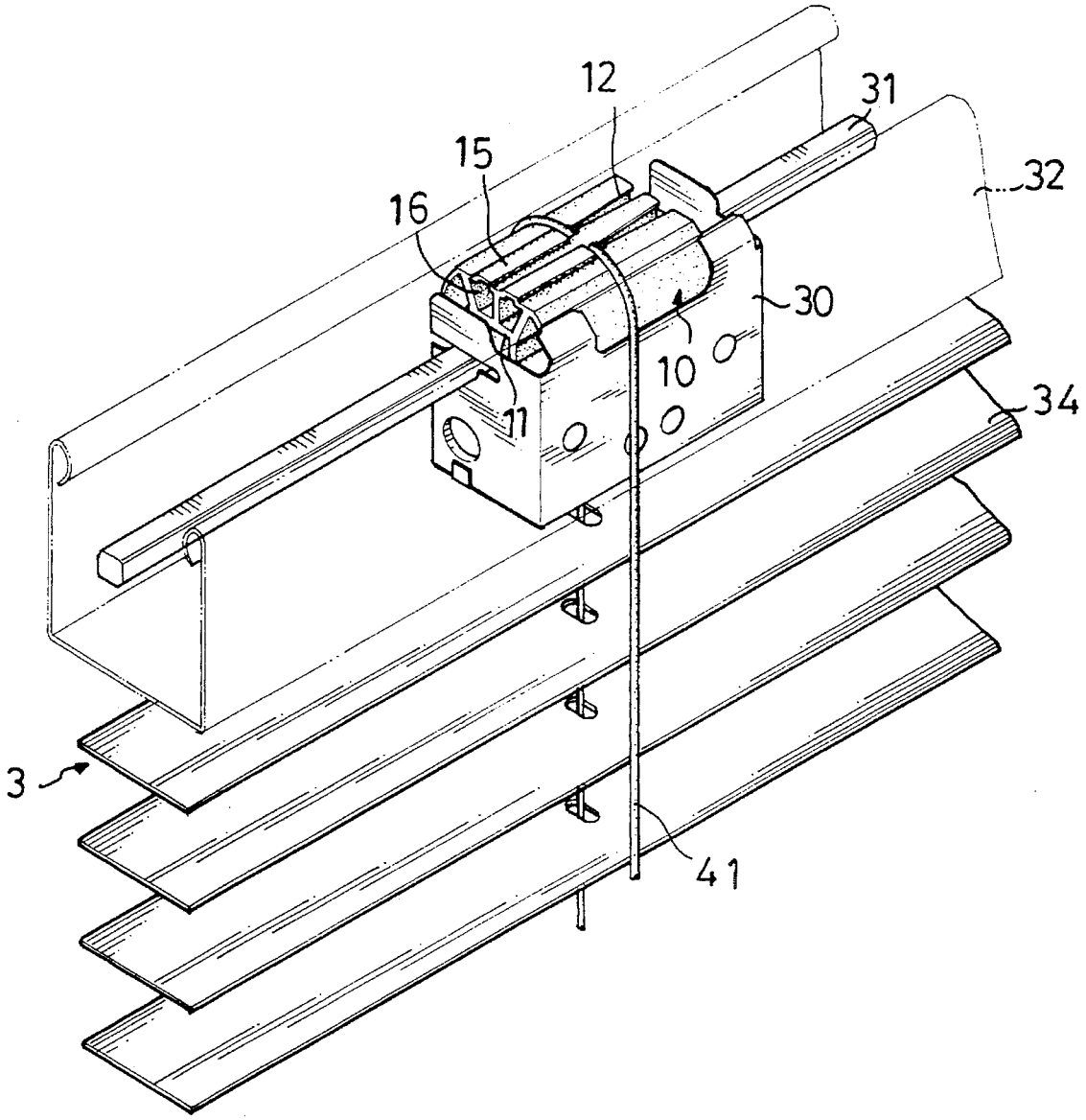
FIG. 3 is a perspective view showing the positioning drum device in combination with a Venetian blind.

Referring to FIGS. 1–3, a positioning drum device 10 in accordance with a first embodiment of the present invention is provided for a Venetian blind 3 which comprises a headrail 32 substantially U-shaped in section, at least one positioning base 30 fixedly mounted in the headrail 32, the positioning drum device 10 rotatably mounted in the positioning base 30 and comprising a top surface and a bottom portion, an axial bore 11 horizontally defined through a mediate portion of the positioning drum device 10, an elongated control rod 31 extending through the axial bore 11 so as to control angular movement and rotational angles of the positioning drum device 10, two adjacent elongated recesses 12 defined in one distal end of the top surface of the positioning drum device 10 and spaced with a distance from each other, the elongated recess 12 being substantially V-shaped and having a neck portion 13 with a reduced diameter formed in a mediate portion of the top surface, a pair of retaining openings 14 defined in the top surface and each communicating with the neck portion 13 of a corresponding one of the recesses 12 and each having a diameter greater than that of the associated neck portion 13, a pair of cords 41 each having a first free end 410 extending through a corresponding one of the openings 14 and each having a diameter greater than that of the associated neck portion 13, a stop 411 mounted on a bottom portion of the first free end 410 of each of the cords 41 and having a diameter greater than that of the opening 14 such that the stop 411 is securely retained in the associated opening 14 so as to position the free end 410 of each of the cords 41 in the associated opening 14.

Preferably, two adjacent passages 16 are longitudinally defined through an upper portion of the positioning drum device 10 and each communicate with a corresponding one of the openings 14 and the associated recess 12 such that each of the stops 411 of the free end 410 of the associated cord 41 is capable of being placed in the associated passage 16. In assembly, referring to FIGS. 1 and 2, each of the first free ends 410 is initially urged in one distal end of the associated recess 12 in a perpendicular fashion with the stop 411 thereof to be disposed under the associated recess 12 in an oblique or horizontal manner, then the first free end 410 is gradually pressed and deformed to displace forward in the recess 12 to pass through the neck portion 13 into the opening 14 with the stop 411 thereof placed in the associated passage 16 (see FIG. 2 in phantom lines), thereby positioning the free end 410 by the associated opening 14. It is appreciated that the diameter of the first free end 410 is greater than that of the neck portion 13 and the diameter of the stop 411 is greater than that of the opening 14, therefore, the stop 411 is securely locked in the associated opening 14, thereby positioning the first free end 410 of the cord 41 without a possibility of being detached therefrom. Each of the two cords 41 has a second free end extending downwardly from which a plurality of webs extend therebetween to support a plurality of slats 34 so as to control angular movement and rotational angles of the plurality of slats 34. Preferably, there are two reinforcing portions 15 integrally formed on the top surface of the positioning drum device 10 each located above a corresponding one of the passages 16.

Figure 4:
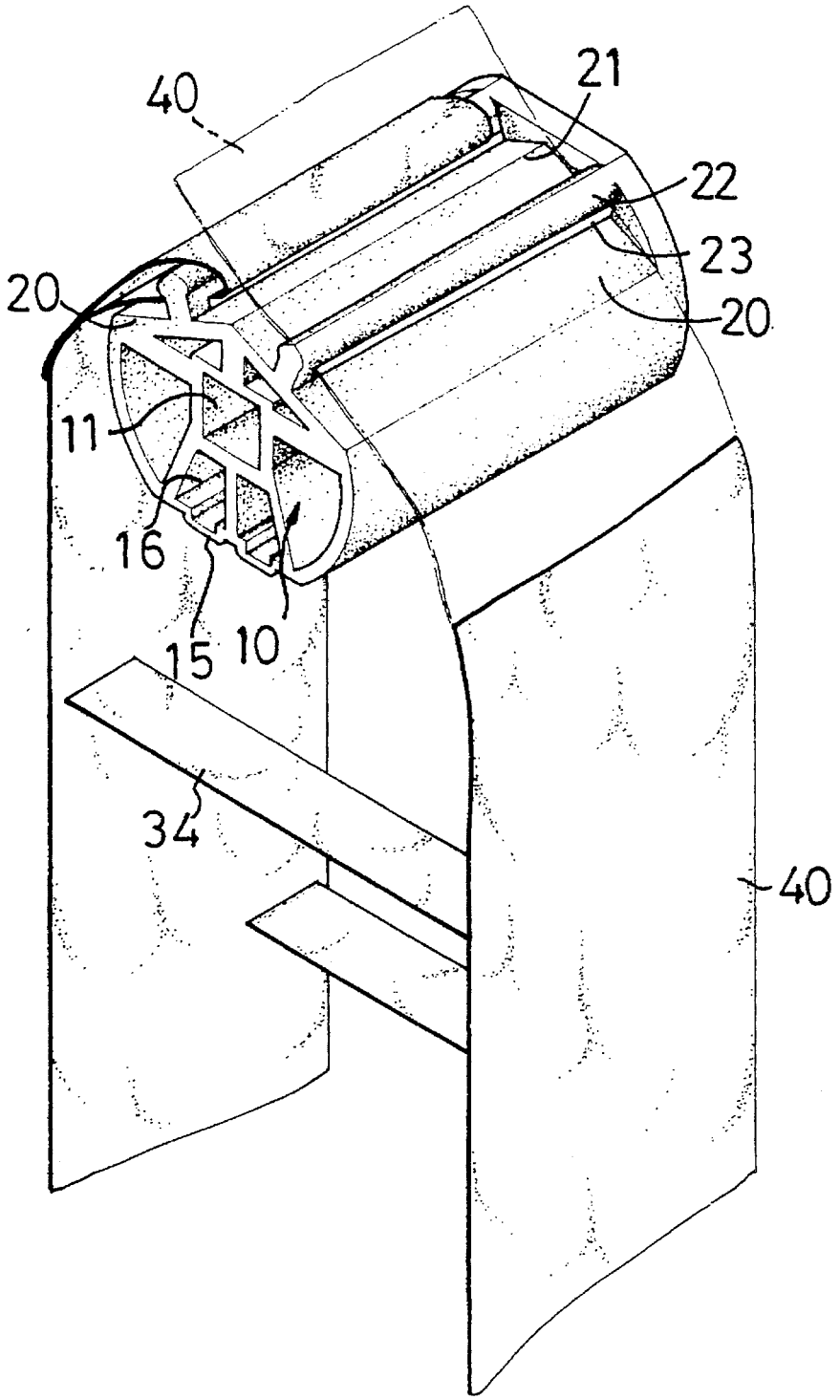
FIG. 4 is a perspective assembly view of a positioning drum device in accordance with a second embodiment of the present invention.

Referring to FIG. 4, in accordance with a second embodiment of the present invention, two inclined planes 20 are longitudinally formed on the bottom portion of the positioning drum device 10, each of the inclined planes 20 extending upwardly and inwardly and intersecting at a topmost summit 21, two substantially U-shaped positioning members 22 each longitudinally formed on a mediate portion 19 of a corresponding one of the inclined planes 20, an elongated slot 23 defined between each of the U-shaped positioning members 22 and the associated inclined plane 20, two flexible tapes 40 each having a first free end passing through a corresponding one of the elongated slots 23 and enclosing the associated U-shaped positioning member 22 to form a loop thereof, thereby positioning the free end of the flexible tape 40 on the associated U-shaped positioning member 22. Each of the two flexible tapes 40 has a second free end extending downwardly from which a plurality of webs extend therebetween to support a corresponding plurality of slats so as to control angular movement and rotational angles of the plurality of slats.

Accordingly, by such an arrangement, the positioning drum device is easy to be assembled and has a rigid engaging structure thereof. In addition, the positioning drum device can provide two functions suitable for a type of Venetian blind with a plurality of slats whose angular movement and rotational angles are controlled by cords or tapes.

It should be clear to those skilled in the art that further embodiments of the present invention may be made without departing from the teachings of the present invention.

What is claimed is:

1. A positioning drum device for a Venetian blind which comprises a headrail substantially U-shaped in section, at least one positioning base fixedly mounted in said headrail, said positioning drum device rotatably mounted in said positioning base and comprising a top surface and a bottom portion, an axial bore horizontally defined through a mediate portion of said positioning drum device, two adjacent elongated recesses defined in one distal end of said top surface of said positioning drum device, each of said two elongated recesses being substantially V-shaped and having a neck portion with a reduced diameter formed in a mediate portion of said top surface, a pair of retaining openings each defined in said top surface and each communicating with said neck portion of a corresponding one of said two recesses and each having a dimension greater than that of an associated said neck portion, a pair of cords each having a first free end extending through a corresponding one of said two openings and each having a diameter greater than the dimension of an associated said neck portion, a stop mounted on a bottom portion of said free end of each of said two cords and having a dimension greater than that of an associated said opening such that said stop is securely retained in an associated said opening so as to position said free end of each of said two cords in an associated said opening.

2. The positioning drum device in accordance with claim 1, wherein said two recesses are spaced a distance from each other.

3. The positioning drum device in accordance with claim 1, further comprising two adjacent passages each longitudinally defined through an upper portion of said positioning drum device and each communicating with a corresponding one of said two openings and an associated said recess, each of said stops of an associated said first free end of said cord capable of being placed in an associated said passage.

* * * * *